US010122155B2

(12) United States Patent
Schremmer et al.

(10) Patent No.: US 10,122,155 B2
(45) Date of Patent: Nov. 6, 2018

(54) CORONA IGNITION SYSTEM FOR AN INTERNAL COMBUSTION ENGINE

(71) Applicant: BorgWarner Ludwigsburg GmbH, Ludwigsburg (DE)

(72) Inventors: Torsten Schremmer, Ludwigsburg (DE); Thomas Holzschuh, Roth (DE)

(73) Assignee: BORGWARNER LUDWIGSBURG GMBH, Ludwigsburg (DE)

( * ) Notice: Subject to any disclaimer, the term of this patent is extended or adjusted under 35 U.S.C. 154(b) by 345 days.

(21) Appl. No.: 14/938,534

(22) Filed: Nov. 11, 2015

(65) Prior Publication Data

US 2016/0141841 A1 May 19, 2016

(30) Foreign Application Priority Data

Nov. 13, 2014 (DE) ..... 10 2014 116 586

(51) Int. Cl.

| | |
|---|---|
| ***F23Q 3/00*** | (2006.01) |
| ***H01T 19/00*** | (2006.01) |
| ***H01T 13/50*** | (2006.01) |
| *F02P 3/01* | (2006.01) |

(52) U.S. Cl.

CPC ..... *H01T 19/00* (2013.01); *H01T 13/50* (2013.01); *F02P 3/01* (2013.01)

(58) Field of Classification Search

USPC ..... 361/263; 123/606, 608, 620

See application file for complete search history.

(56) References Cited

U.S. PATENT DOCUMENTS

| | | | | |
|---|---|---|---|---|
| 3,035,108 | A * | 5/1962 | Kaehni | F02P 3/01 123/606 |
| 8,869,765 | B2 * | 10/2014 | Braeuchle | F02P 23/045 123/143 B |
| 2011/0114071 | A1 | 5/2011 | Freen | |
| 2012/0055430 | A1 * | 3/2012 | Braeuchle | F02P 23/045 123/143 B |
| 2012/0055455 | A1 | 3/2012 | Ruan et al. | |
| 2012/0055730 | A1 * | 3/2012 | Mukai | B62D 5/008 180/444 |
| 2012/0192624 | A1 | 8/2012 | Visser et al. | |
| 2013/0208393 | A1 * | 8/2013 | Hampton | F02P 9/002 361/247 |

(Continued)

FOREIGN PATENT DOCUMENTS

| | | |
|---|---|---|
| CA | 2 856 543 A1 | 9/2014 |
| DE | 10 2011 052 096 A1 | 3/2012 |

*Primary Examiner* — Ronald W Leja

(74) *Attorney, Agent, or Firm* — Bose McKinney & Evans LLP

(57) ABSTRACT

A corona ignition system is described for igniting fuel in a combustion chamber of an internal combustion engine, with a resonant circuit, which contains an ignition electrode, a high frequency generator connected to the resonant circuit, in order to generate an AC voltage for exciting the resonant circuit, and a direct current voltage source, in order to generate an input voltage for the high frequency generator. According to this disclosure, provision is made that parallel to the direct current voltage source a capacitor is connected to the high frequency generator, which capacitor on transient oscillation of the resonant circuit compensates mismatches between the resonant circuit and the direct current voltage source.

7 Claims, 1 Drawing Sheet

(56) References Cited

U.S. PATENT DOCUMENTS

| | | | | |
|---|---|---|---|---|
| 2014/0358399 | A1* | 12/2014 | Schremmer | F02P 17/00<br>701/101 |
| 2016/0141841 | A1* | 5/2016 | Schremmer | H01T 19/00<br>361/263 |
| 2017/0030323 | A1* | 2/2017 | Bohne | F02P 3/06 |
| 2018/0006435 | A1* | 1/2018 | Holzschuh | F02P 23/04 |

* cited by examiner

CORONA IGNITION SYSTEM FOR AN INTERNAL COMBUSTION ENGINE

RELATED APPLICATIONS

This application claims priority to DE 10 2014 116 586.1, filed Nov. 13, 2014, the entire disclosure of which is hereby incorporated herein by reference in its entirety.

BACKGROUND

The invention relates to a corona ignition system for the igniting of fuel in a combustion chamber of an internal combustion engine.

US 2011/0114071 A1 discloses a corona ignition system, by which a fuel-air mixture can be ignited in a combustion chamber of an internal combustion engine by means of a corona discharge generated in the combustion chamber. This corona ignition system has an ignition electrode which is situated in an insulator. The ignition electrode, together with the insulator and a sleeve surrounding the insulator, forms an electrical capacitor. This capacitor is part of an electrical resonant circuit of the corona ignition device, which is excited with a high frequency AC voltage for example from 30 kHz to 50 MHz. Thereby, a voltage excess results at the ignition electrode, so that a corona discharge forms at the latter.

The high frequency AC voltage is generated by a high frequency generator, the input voltage of which is generated by a transformer from the on-board electrical system of the vehicle.

A corona discharge forms ions and radicals in a fuel-air mixture in the combustion chamber of an engine. When a critical concentration of ions and radicals is reached, the fuel-air mixture ignites. The rate at which ions and radicals are produced depends on the size of the corona discharge and its electrical output. The size and output of a corona discharge can be increased only up to a critical limit. If this limit is exceeded, the corona discharge transitions into an arc discharge or spark discharge.

Corona ignition systems are generally controlled so that the corona discharge is as large as possible, so that fuel-air mixture can be ignited as rapidly as possible and therefore the moment of ignition can be predetermined as precisely as possible, but a breaking through of the corona discharge into an arc or spark discharge is prevented.

SUMMARY

This disclosure teaches how this aim can be achieved even better.

Resonant circuits of corona ignition systems have a very high quality factor and therefore generate a high reactive power during transient oscillation. This results in mismatches, so that only a fraction of the output provided by the high frequency generator during the transient process can be received by the resonant circuit. For this reason, the ideal input voltage of the high frequency generator is less during the transient process than in the steady state. This effect can be compensated in corona ignition systems by a control which causes the direct current voltage source of the high frequency generator to deliver a lesser voltage during the transient oscillation of the resonant circuit, i.e., on igniting a corona discharge, than in the case of a corona discharge burning in a stable manner. The effort involved with such a control can be avoided by the measure according to this disclosure that parallel to the direct current voltage source, e.g., a transformer, a capacitor is connected to the high frequency generator, which capacitor, during the transient oscillation of the resonant circuit, compensates mismatches between the resonant circuit and the direct current voltage source.

When a corona ignition system according to this disclosure is put into operation, the capacitor connected to the high frequency generator parallel to the direct current voltage source becomes charged whilst the resonant circuit is in transient oscillation. The input voltage of the high frequency generator therefore increases with time during the transient process of the resonant circuit, whereby mismatches of the system are compensated. Thus, the capacitor connected to the high frequency generator parallel to the direct current voltage source reduces excess voltages occurring in the high frequency generator on switching on or switching off.

The direct current voltage source can be, for example, a DC/DC converter. With a converter, the input voltage for the high frequency generator can be generated for example from the on-board electrical system of the vehicle. This can take place directly, i.e., with a single-stage converter, or in several steps. The voltage generated by the converter can be for example 50 V to 400 V. Depending on the design of the high frequency generator, however, higher or lower input voltages can also be used.

The optimum capacity of the capacitor depends on the conditions of the high frequency generator, of the resonant circuit and also of the direct current voltage source, which delivers the input voltage for the high frequency generator and can therefore not be given universally. Generally, good results can be achieved with capacitors of a capacitance between 20 μF and 100 μF. Depending on the corresponding design of the corona ignition system, however, a capacitor with a higher or smaller capacitance can also be appropriate.

When the high frequency generator is put into operation, the capacitor reduces the voltage applied to it for example by 10 V to 75 V. Depending on the reactive power of the resonant circuit other values might be advantageous. The voltage then increases according to the charging curve of the capacitor. This voltage rise can be, at the beginning, for example between 0.5 V/μs and 5 V/μs or else between 0.5 V/μs and 3 V/μs.

The capacitor, connected to the high frequency generator parallel to the voltage source is advantageous not only during the transient oscillation phase of the resonant circuit, i.e., on igniting of a corona discharge, but also during the extinguishing of a corona discharge, i.e., the switching off of the corona ignition system. In this case, the direct current voltage source is separated from the high frequency generator, for example switched off. The high frequency generator is then still supplied from the capacitor for a short time, wherein the capacitor discharges and therefore on extinguishing of the corona discharge can receive any excess voltages which may be occurring.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

Figures 1, 1A:
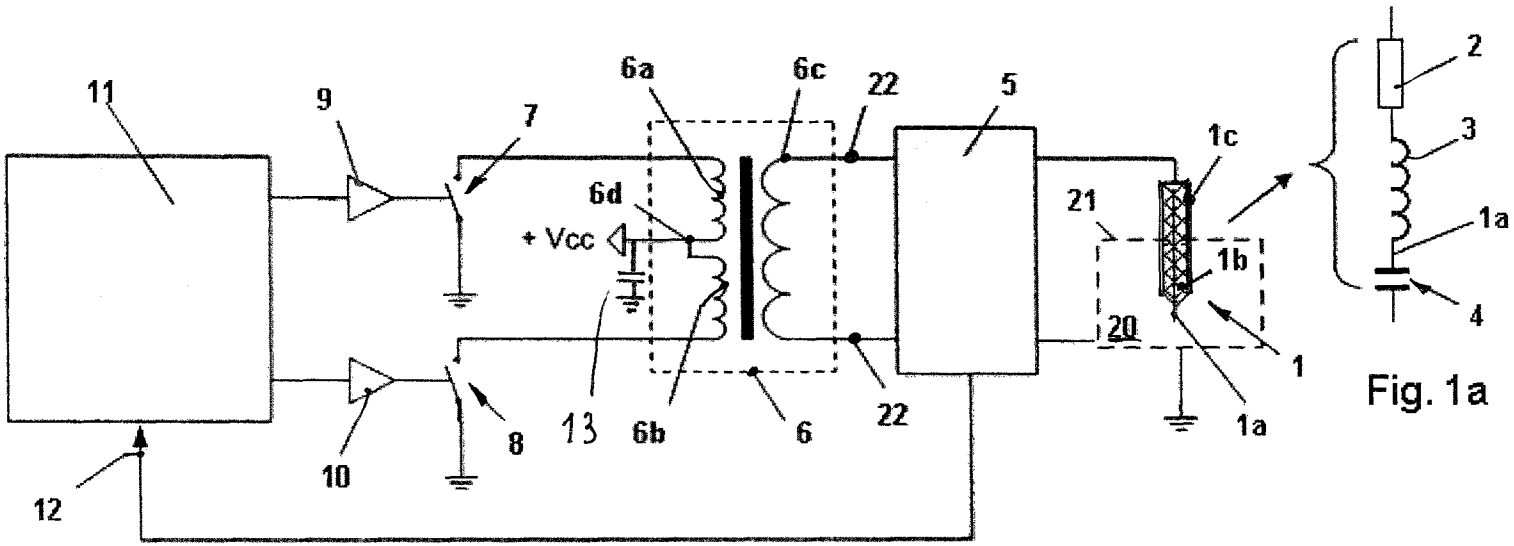
FIG. 1 shows diagrammatically the structure of a first corona ignition system for a vehicle engine.
FIG. 1*a* shows as a detail the fundamental components of a corona igniter, which is at the same time the essential component of a HF resonant circuit.

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

FIG. 1 shows a combustion chamber 20, which is delimited by walls 21, which lie at ground potential. A corona igniter 1 projects into the combustion chamber 20. The corona igniter 1 has an ignition electrode la, which is surrounded on a portion of its length by an insulator 1*b*. The insulator 1*b* is surrounded by a metallic outer conductor 1*c*. The ignition electrode 1*a* surrounded by the insulator 1*b* and the metallic outer conductor 1*c* protrudes in an electrically insulated manner through the wall 21 into the combustion chamber 20. If the igniter 1 does not have a separate outer conductor, the combustion chamber wall 21 can also serve as outer conductor, in which the igniter 1 is placed. The igniter 1 and the walls 21 of the combustion chamber 20 are a component of a series resonant circuit, to which in addition a capacitor 4, an inductor 3 and an ohmic resistor 2 belong. Of course, the series resonant circuit can have further inductors and/or capacitors and other structural elements which are known to persons skilled in the art as possible components of series resonant circuits.

To excite the HF resonant circuit, a high frequency generator is provided, which has as DC/AC converter 6 a transformer with a center tap 6*d* on its primary side. The high frequency generator is supplied by a DC/DC converter, which produces an input voltage Vcc of for example 50 V to 400 V from an on-board electrical system of the vehicle. Parallel to the DC/DC converter, a capacitor 13 is connected to the center tap 6*d* of the high frequency generator.

Two primary windings 6*a* and 6*b* are connected at the center tap 6*d*. The ends of the primary windings 6*a* and 6*b* remote from the center tap 6*d* are alternately connected to ground by means of a high frequency switchover device which has two power switches 7 and 8. The switching frequency of the high frequency switchover device determines the frequency at which the series resonant circuit (FIG. 1*a*) is excited and is able to be altered by means of a control circuit 11. The secondary winding 6*c* of the transformer 6 supplies the series resonant circuit at an interface 22. The high frequency switchover device with the power switches 7, 8 is controlled by means of the control circuit 11 so that the HF resonant circuit connected to the interface 22 is excited with its resonance frequency or approximately with its resonance frequency. The voltage is then greatest between the tip of the ignition electrode 1*a* and the walls 21 which are at ground potential.

Between the HF resonant circuit and the secondary winding 6*c* of the transformer 6, a detector circuit 5 can be provided, in order to detect the zero crossing of the current intensity of the current signal in the HF resonant circuit.

In the illustrative embodiment, the center tap 6*d* of the transformer 6 is connected with a DC/DC converter, which provides the input voltage Vcc for the high frequency generator. The other two connections of the primary windings 6*a* and 6*b* of the transformer 6 are by turns switched to ground via the power switches 7 and 8. However, it would also be possible to connect the center tap 6*d* with ground and to connect the two other connections of the primary windings 6*a* and 6*b* via the power switches 7 and 8 with the voltage source, which delivers the voltage Vcc.

The control circuit 11 controls when and for what duration the power switches 7 and 8 are closed. For this purpose, the detector circuit 5 signals via a line 12 leading to the control circuit 11 every zero crossing of the current intensity of the current signal flowing in the HF resonant circuit, whereupon the control circuit 11 generates alternately pulse-shaped control signals for the closing of the power switch 7 and the opening of the power switch 8 or respectively for the closing of the power switch 8 and the opening of the power switch 7, wherein these control signals can be further amplified by amplifiers 9 and 10.

The control circuit 11 can be constructed in various ways. For example, it can be a microcontroller, it can also be a field programmable gate array (abbreviation: FPGA), i.e., an integrated switching circuit of digital technology, into which a logic circuit can be programmed. The control device 11 can also be a complex programmable logic device (CPLD) or an ASIC, i.e., an application-specific integrated circuit, or another logic circuit.

In the transformer 6 an alternating field is generated, which leads to a high voltage on the secondary side of the transformer and excites the HF resonant circuit connected to the transformer 6 at a frequency which coincides with the resonance frequency of the resonant circuit or lies close to the resonance frequency.

On transient oscillation of the HF resonant circuit, the latter involves a high reactance. During the transient process, the power input of the HF resonant circuit is therefore made difficult and is reduced compared with the power input in a steady resonant circuit. To prevent excess voltages, the high frequency generator is therefore supplied initially with a reduced input voltage, which is increased during the transient process until at the end of the transient process a final value is reached, which is adjusted to the power input of the steady resonant circuit.

The initial lowering of the input voltage of the high frequency generator is achieved with the capacitor 13 in the embodiment shown. When the high frequency generator is put into operation, the capacitor 13 becomes charged, so that not the entire voltage Vcc delivered by the DC/DC converter is applied at the high frequency generator, but rather only a reduced voltage. The high frequency generator therefore at first receives a correspondingly reduced electrical output. Whilst the capacitor 13 is charging, the voltage applied at the high frequency generator increases accordingly, until finally the full voltage Vcc provided by the DC/DC converter is applied at the high frequency generator. The capacitor 13 thus reduces a mismatch which is present during the transient process between the DC/DC converter or respectively the voltage Vcc delivered by it and the resonant circuit.

Both the time necessary for the charging of the capacitor 13 and also the extent of the reduction, brought about by the capacitor, of the voltage applied at the high frequency generator are determined by the capacitance of the capacitor 13. The capacitance of the capacitor 13 is to be selected appropriately depending on the requirements of a given system. Generally, capacitances between 20 μF and 100 μF are sufficient, in order to largely compensate mismatches between resonant circuit and DC/DC converter. During the transient process of the resonant circuit the capacitor 13 of the embodiment shown limits the change of the input voltage of the resonant circuit to no more than 5 V/μs, e.g., 3 V/μs or less.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMBERS

1 HF igniter
1*a* ignition electrode
1*b* insulator
1*c* outer conductor
2 ohmic resistor
3 inductor
4 capacitor
5 detector circuit
6 DC/AC converter, transformer
6*a* primary winding
6*b* primary winding
6*c* secondary winding
6*d* center tap
7 power switch
8 power switch
9 amplifier
10 amplifier
11 control circuit
12 line
13 capacitor
20 combustion chamber
21 combustion chamber wall
22 interface

What is claimed is:

1. A corona ignition system for igniting fuel in a combustion chamber of an internal combustion engine, comprising:

a resonant circuit, which comprises an ignition electrode;

a high frequency generator, which is connected to the resonant circuit and configured to generate an AC voltage for exciting the resonant circuit;

a direct current voltage source configured to generate an input voltage for the high frequency generator wherein the direct current voltage source is a converter and delivers a voltage between 50 V and 400 V; and a capacitor that is connected to the high frequency generator in parallel to the direct current voltage source, wherein, during transient oscillation of the resonant circuit when the high frequency generator is first activated, the capacitor compensates mismatches between the resonant circuit and the direct current voltage source by reducing the voltage applied to the high frequency generator by the direct current voltage source.

2. The corona ignition system according to claim 1, wherein the capacitor has a capacitance between 20 μF and 100 μF.

3. The corona ignition system according to claim 1, wherein the capacitor and the direct current voltage source are connected to the same voltage input of the high frequency generator.

4. The corona ignition system according to claim 1, wherein the high frequency generator comprises a transformer with a center tap and both the direct current voltage source and also the capacitor are connected to the center tap.

5. The corona ignition system according to claim 1, wherein during the transient process of the resonant circuit the capacitor limits an alteration of the input voltage of the resonant circuit to no more than 5 V/ μs.

6. The corona ignition system according to claim 1, wherein the capacitor reduces the voltage applied to the high frequency generator during transient oscillation of the resonant circuit by a voltage within the range of 10 V to 75 V.

7. A corona ignition system for igniting fuel in a combustion chamber of an internal combustion engine, comprising:

a resonant circuit, which comprises an ignition electrode;

a high frequency generator, which is connected to the resonant circuit and configured to generate an AC voltage for exciting the resonant circuit;

a direct current voltage source configured to generate an input voltage for the high frequency generator; and a capacitor that is connected to the high frequency generator in parallel to the direct current voltage source, wherein, during a corona discharge event:

(a) during transient oscillation of the resonant circuit when the high frequency generator is first activated the capacitor is being charged whereby less than the full voltage provided by the direct current voltage source is applied to the high frequency generator;

(b) after charging the capacitor, the full voltage provided by the direct current voltage source is applied to the high frequency generator with the resonant circuit in a steady state; and (c) after separating the direct current voltage source from the high frequency generator, the capacitor is discharged and the corona discharge is extinguished.

* * * * *